US005542216A

United States Patent [19]

Mohler

[11] Patent Number: 5,542,216

[45] Date of Patent: Aug. 6, 1996

[54] SLIDING DOOR CLOSING DEVICE

[76] Inventor: Thomas H. Mohler, 2596 Patricia Dr., Santa Clara, Calif. 95051

[21] Appl. No.: 399,875

[22] Filed: Mar. 7, 1995

[51] Int. Cl.[6] ..... E05D 15/06

[52] U.S. Cl. ..... 49/404; 49/451; 16/72

[58] Field of Search ..... 49/404, 451, 450; 160/369; 16/72, DIG. 10, DIG. 36, DIG. 67, DIG. 17

[56] References Cited

U.S. PATENT DOCUMENTS 3,891,111 6/1975 Snazuk ..... 16/72 X 4,382,311 5/1983 Watts ..... 16/72 X 4,819,295 4/1989 Kaftan ..... 16/72

*Primary Examiner*—Philip C. Kannan

*Attorney, Agent, or Firm*—T. R. Zegree

[57] ABSTRACT

A device for closing a sliding door comprises a pair of slidable telescoped tubes. The device is secured at its outer ends to the sliding door and to a supporting door frame. A compression spring is located within the tubes urging the sliding door to return by itself from its open to its closed position. A string extends between the end portions of the tubes to prevent the tubes from being separated and a clamping means is adapted for locking the sliding door in any desired open position.

16 Claims, 1 Drawing Sheet

SLIDING DOOR CLOSING DEVICE

BACKGROUND OF THE INVENTION

This invention relates to an improved device for closing a sliding

More particularly, the invention relates to a device adapted for closing a sliding door, whereby the sliding door in an open position can be returned by itself to its closed position by its own power.

As is known, various types of closing devices for sliding doors have been described in the patent literature. For example, U.S. Pat. No. 3,278,979 to Clement describes a sliding door closer comprising a pair of telescoped tubes, a suction washer and a bleeder valve for a slow escape of air from the inner tube. U.S. Pat. No. 3,732,594 to Mills discloses hardware having a pintle for control of the movement of one or two sash with respect to each other or their frame. U.S. Pat. No. 4,004,372 to Beard et al shows a closer for a sliding door having a pivot shaft, means for cushioning movement of the door and a rod extending member having a magnet attached thereto. U.S. Pat. No. 4,539,726 to Bostian describes a spring biased prop for a pivoted door comprising a pair of telescoping tubes having internally flared portions, each having a hole for receiving a shaft of a support means; and U.S. Pat. No. 5,313,739 to Nelson et al discloses a sliding door closure system comprising a telescoping housing unit, a plurality of spring biasing members and a tension-reducing unit.

While the above-listed patents describe various door closures having different structures, the door closing device of the present invention provides a new approach to the structure and operation thereof which offers certain advantages over the prior art door closers.

OBJECTS OF THE INVENTION

In view of the foregoing, it is the principal object of my invention to provide an improved door closing device for a sliding door which can easily and quickly be opened manually and closed by self-movement.

Another object of the invention involves another door closing device which can be operated by locking the door in an open position in any desired location.

Still another object of the invention is to provide a sliding door opening and closing device which permits a highly efficient and easy operation and which can be manufactured at a low cost from readily available materials.

BRIEF SUMMARY OF THE INVENTION

These and other objects of the present invention will become more fully apparent from the following description considered in-conjunction with the accompanying drawings.

In accordance with the invention, there is provided an elongated device for closing a sliding door adapted for mounting in a moor frame. The device comprises in combination: a) an outer tube and an inner tube slidable therein and disposed in a coaxial telescopic relation therewith; b) a unitary coil compression spring located within the inner tube and extending throughout the length of the device with the ends of the spring being secured to the end portions of the device; c) a pair of end cap members mounted on the outer end potion of each tube, each cap member having a central aperture therein; d) a restraining string extending throughout the length of the device, the ends of the string passing through the apertures in the cap members; e) a front bracket for securing the outer end of the outer tube to the front wall of the sliding door and a rear bracket affixed to the rear portion of the door frame for securing the outer end of the inner tube to the door frame; and f) a clamping means mounted on the rear wall of the sliding door for locking the inner tube in any position whenever the sliding door is open.

BRIEF DESCRIPTION OF THE DRAWINGS

In the accompanying drawings, wherein like reference characters designate corresponding elements throughout the views thereof.

DETAILED DESCRIPTION OF THE INVENTION

Figure 1:
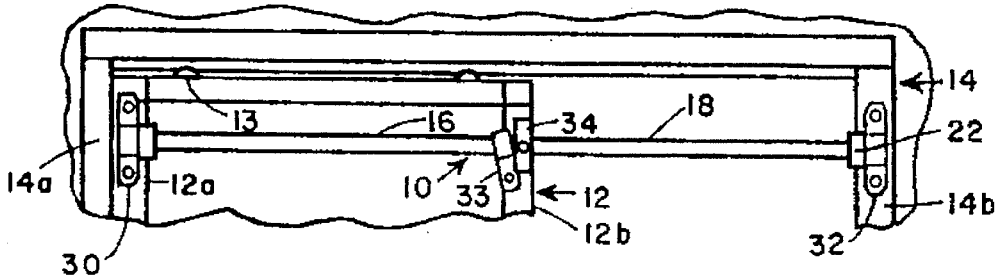
FIG. 1 is a fragmentary front elevational view showing a sliding door with the closing device in closed position.
Figure 2:
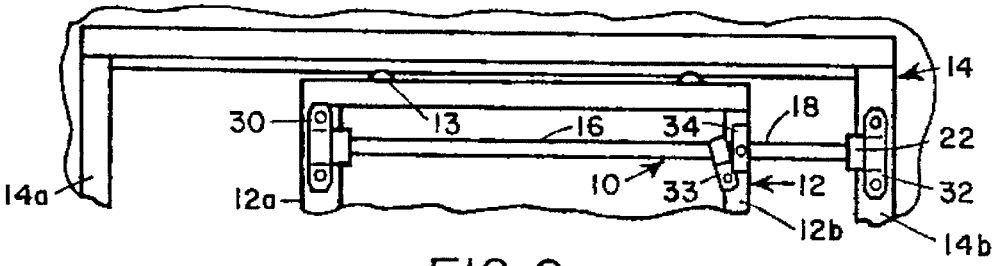
FIG. 2 is a similar view of the door in open position.

Referring how to the drawings, closing device 10 is shown in FIGS. 1 and 2 in association with sliding door 12 provided with conventional wheels 13 mounted on upper and lower edges for reciprocal sliding of the screen door. Front wall 12*a* and rear wall 12*b* form the vertical portions of sliding door 12 which is positioned in the standard manner in stationary door frame 14 having front frame 14*a* and rear frame 14*b* in parallel relation to each other. Closing device 10 comprising hollow outer tube 16 and hollow inner tube 18 slidably disposed inside outer tube 16 in frictional engagement and a coaxial telescopic relationship therewith is secured at its front end to sliding door front wall 12*a* by means of front metal bracket 30 and to rear frame 14*b* of door frame 14 by means of rear metal bracket 32, both brackets being secured by suitable fasteners, such as screws 42 and 44, device 10 being axially aligned with the upper edge of door frame 14 preferably a short distance thereunder. Outer tube 16 is maintained fixed by suitable holder 33 affixed at one end thereof to rear wall 12*b* of door 12. A screw band clamp member may be suitable for this purpose.

Figure 3:
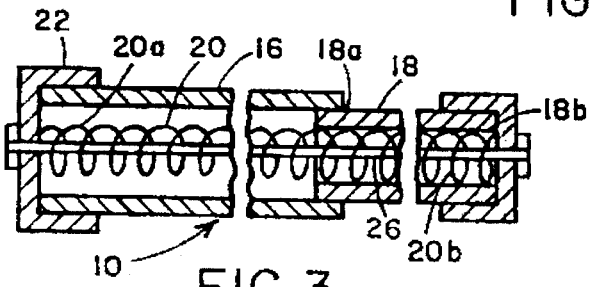
FIG. 3 is an exploded sectional view of the device with the spring a relaxed position.
Figure 4:
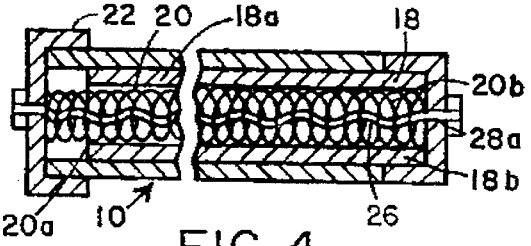
FIG. 4 is a similar view with the spring compressed when the door is open.
Figure 5:
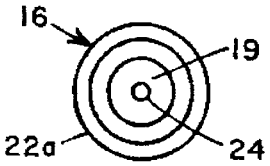
FIG. 5 is a side view of an inner cap member.
Figure 6:
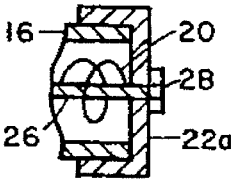
FIG. 6 is a fragmentary sectional rear end view of the device showing the string and an inner cap member.
Figure 7:
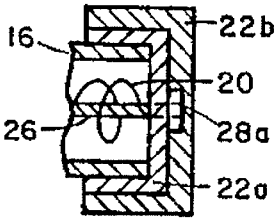
FIG. 7 is a similar view showing inner and outer cap members.

Device 10 further includes, as one of its essential components, a unitary helical compression spring shown in FIGS. 3 and 4 located within inner tube 18 and extending continuously throughout the entire length of device 10, the front end 20*a* being secured to the outer end of outer tube 16 and the rear end of spring 20 being secured to the outer end of inner tube 18*b* and held by end cap members 22 comprising preferably inner cap 22*a* and outer cap 22*b*, each cap member 22 being fittingly mounted on the outer open end portions each tube, thereby enclosing the open ends of the tubes. Each cap member 22 is provided with a small aperture 24 in the center thereof, as shown in FIG. 5, for passage of end portions of sturdy restraining string 26 therethrough, string 26 extending from one end of device 10 to the other end thereof and being anchored at both ends thereof by stop means 28, as shown in FIG. 6, disposed downwardly of cap members 22. Stop means 28 comprises preferably a small stop cross bar 28*a* shown in FIGS. 4 and 7, holding the ends of string 26 in place regardless of its fully stretched or relaxed position inside device 10. Instead of cross bar 28*a*, string 26 may optionally be attached by knotting on the outerside of aperture 24 or by any other suitable stopper. While both inner caps 22*a* contact the outer surfaces of device 10 at its end portions thereby providing closures for the open ends thereof, outer caps 22*b* are fitted over inner caps 22*a*, as shown particularly in FIG. 7.

Figure 8:
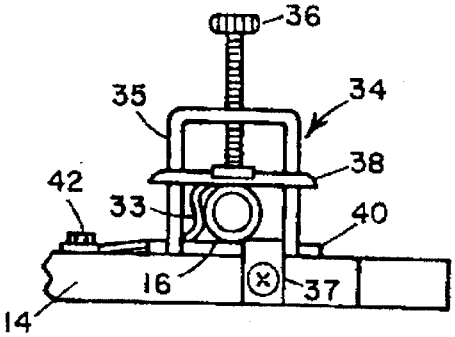
FIG. 8 is a detailed side view of the clampling means mounted on a screen door frame.
Figure 9:
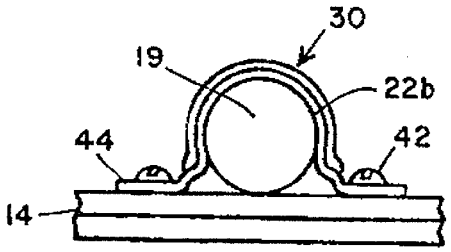
FIG. 9 is a side view of a bracket holding the open end portion of an outer tube.

Another important element included in the structure of device 10 is clamping means 34 for inner tube 18, illustrated in detail in FIG. 8, which is mounted on rear wall 12*b* of sliding door 12 coaxially with brackets 30 and 32. Clamping means 34 comprises an inverted U-shaped member 35, the lower ends of which are affixed to horizontally disposed base 40 secured to rear wall 12*b* by threaded screw member 42 or the like fasteners passing through holes provided in base 40 therefor. Clamping means 34 further comprises a threaded bolt member 36 extending downwardly through a hole in the horizontal portion of U-shaped member 35 and being movable down to the free end of bolt member 36 connected to transverse bar 38 at the center thereof, thereby lowering or raising bar 38 by manual handling of bolt member 36. Inner tube 18 is located between transverse bar 38 and base 40 and can be locked turning bolt 36 downwardly until bar 38 engages the outer surface of inner tube 18 thereby preventing sliding door 12 from a sliding movement when maintained in an open position in any desired location. Returning now to brackets 30 and 32, front end bracket 30 is affixed to front wall 12*a* of sliding door 12 and rear end bracket 32 is affix to the rear portion 14*b* of door frame 14. Both tubes 16 and 18 are firmly held in their respective positions by brackets 30 and 32 in a mutually tightfitting relation, yet being freely slidable. FIG. 9 shows front bracket 30 holding end portion 19 of outer tube 16 covered by outer cap 22*b*, bracket 30 having a pair of arms 44 extending laterally and secured to door frame 14 by screws 42.

It will be apparent from the foregoing description that I have devised an improved lightweight, durable device for closing sliding doors which is useful in providing a safe and efficient reciprocal sliding movement of the door. While the device is primarily suitable for use on sliding screen doors, it may also be used on sliding closet doors, patio glass doors, cupboards, industrial equipment doors and the like. While the spring held within the telescopically interfitting tubes actuates the movement of the sliding door, its important function is to urge the sliding door from its open to its closed position by compression force driving the spring to return the sliding door by self-closing movement to its original closed position. The cap members fitted on the ends of the inner and outer tubes retain the spring insider the tubes and provide end surfaces against which the spring exerts the force urging the tubes to close the door.

The clamping means serves a useful purpose to lock the inner tube to the outer tube and thus holding the door in any open position of its travel. The door returns safely to its original closed position by simply unscrewing the bolt member thereby freeing the inner tube from being locked.

If desired, a strip of a flexible padding may be attached to the vertical edge of the front door frame to prevent the sliding door from hitting the door frame too hard and to reduce the noise of a sliding door hitting the door frame.

The restraining string, which is likewise an important feature of the invention, may be made of a natural or synthetic line or wire rope. The string prevents the tubes from separating when fully stretched in the closed position of the sliding door when the tubes are removed from the device. When the sliding door is open, the string coils randomly inside the compressed spring.

The brackets holding the free ends of both tubes may be attached to the front wall of the sliding door and to the rear door frame by any suitable fastening means, such as screws, rivets and the like.

Although the cross section of the tubes is preferably circular, it may be square or polygonal. While the size of the tubes may vary to some extent, a suitable diameter of circular tubes may range from about ½ inch to 2 inches, the diameter of the outer tube being slightly larger than that of the inner tube to insure a slidably frictional engagement therebetween.

Due to the fact that various types and sizes of sliding doors are available, the spring force of the device may be adjusted prior to its installation by a) spring trimming to an appropriate length thereby reducing the spring compressive force; b) spring stretching to a greater length thereby increasing the spring force; and c) adjustment rods (not shown) of varying lengths inserted through an end cap member to partially compress the spring and thereby to increase its force.

The installation of the device of this invention is very simple requiring no special tooling with the exception of a screwdriver. In view of the simplicity of its construction, the device may be manufactured inexpensively in a large volume.

It will be understood that various modifications in the form or in the constructional details of the elements of my invention as herein described in its preferred embodiment may be made without departing from the spirit thereof or the scope of the claims which follow.

I claim:

1. An elongated device for closing a sliding door having vertical front and rear walls, said sliding door being adapted for mounting in a door frame, comprising in combination:

a) an outer tube and an inner tube slidable therein and disposed in a coaxial telescopic relation therewith;

b) a unitary coil compression spring located within said inner tube and extending throughout the length of said device with ends of said spring being secured to end portions of said device;

c) a pair of end cap members mounted on outer end portions of each of said tubes, said cap members having a central aperture therein;

d) a restraining string extending throughout the length of said device, the ends of said string passing through said apertures and affixed to outer portions of said cap members;

e) a front bracket for securing said outer end of said outer tube to front wall of said sliding door and a rear bracket affixed to rear portion of said door frame for securing the outer end of said inner tube to said door frame; and f) a clamping means mounted on the rear wall of said sliding door for locking said inner tube whenever said sliding door door is open.

2. The device of claim 1 wherein said inner tube is positioned in a slidably frictional engagement with said outer tube.

3. The device of claim 1 wherein the ends of said spring are retained by said end cap members.

4. The device of claim 1 wherein said end cap members are fitted to enclose open ends of said tubes.

5. The device of claim 1 wherein end portions of said string are anchored outwardly of said end cap members by a stop means.

6. The device of claim 5 wherein said stop means comprises a cross bar.

7. The device of claim 1 wherein each of said end cap members comprises an inner cap and an outer cap fitted over said inner cap.

8. The device of claim 1 wherein said front end bracket is affixed to the front wall of said sliding door.

9. The device of claim I wherein said rear end bracket is affixed to rear portion of said frame.

10. The device of claim 1 wherein said clamping means is adapted for locking said inner tube in any location thereby holding said sliding door in open position.

11. The device of claim 1 wherein said clamping means comprises a threaded screw member connected at free end thereof to a transverse bar movable by said screw member for engagement with outer surface of said inner tube, thereby preventing said inner tube from sliding motion.

12. The device of claim 1 wherein said sliding door is actuated manually to open position and is self-movable to closed position by force of the compressed spring.

13. The device of claim 1 wherein said tubes are held by said brackets in a mutually tight-fitting relation.

14. The device of claim 1 wherein said device is mounted in the upper portion of said door frame adjacent top edge thereof.

15. The device of claim 1 wherein said sliding door is a screen door.

16. In combination, a screen door mounted in a door frame, said screen door being manually operable to open position and self-returnable to closed position by means of the device defined in claim 1.

* * * * *

UNITED STATES PATENT AND TRADEMARK OFFICE

CERTIFICATE OF CORRECTION

PATENT NO. : 5,542,216

DATED : August 6, 1996

INVENTOR(S) : Thomas H. Mohler

It is certified that error appears in the above-indentified patent and that said Letters Patent is hereby corrected as shown below:

Column 1, line 7, after "sliding" insert --door.--;
line 58, correct the spelling of "door"--;
Column 2, line 64, after "portions" insert --of--;
Column 3, line 28, after "locked" insert--by--;
line 33, correct the spelling of "affixed"; and
line 53, correct the spelling of "inside"--.

Signed and Sealed this

Fifteenth Day of October, 1996

Bruce Lehman

*Attest:*

BRUCE LEHMAN

*Attesting Officer*

*Commissioner of Patents and Trademarks*